US009287650B2

(12) United States Patent
Wimmer et al.

(10) Patent No.: US 9,287,650 B2
(45) Date of Patent: Mar. 15, 2016

(54) CONNECTOR AND MATING CONNECTOR

(71) Applicant: Lisa Draexlmaier GmbH, Vilsbiburg (DE)

(72) Inventors: Stefan Wimmer, Hohenthann (DE); Christian Wimmer, Gerzen (DE); Christian Kraxenberger, Burgkirchen (AT); Robert Burgert, Simbach am Inn (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 14/554,154

(22) Filed: Nov. 26, 2014

(65) Prior Publication Data

US 2015/0147902 A1 May 28, 2015

(30) Foreign Application Priority Data

Nov. 28, 2013 (DE) ..... 10 2013 019 874

(51) Int. Cl.

| | |
|---|---|
| ***H01R 13/40*** | (2006.01) |
| ***H01R 13/436*** | (2006.01) |
| ***H01R 13/428*** | (2006.01) |
| *H01R 13/432* | (2006.01) |

(52) U.S. Cl.

CPC ..... *H01R 13/4362* (2013.01); *H01R 13/428* (2013.01); *H01R 13/432* (2013.01); *H01R 2201/26* (2013.01)

(58) Field of Classification Search

CPC ..... H01R 13/432; H01R 13/428; H01R 13/4362; H01R 2201/26

USPC ..... 439/595, 733.1, 744

See application file for complete search history.

(56) References Cited

U.S. PATENT DOCUMENTS

| | | | | |
|---|---|---|---|---|
| 7,661,987 | B2 * | 2/2010 | Adachi | H01R 9/0518 439/595 |
| 8,096,841 | B2 * | 1/2012 | Hirano | H01R 13/4361 439/752 |
| 8,550,845 | B1 * | 10/2013 | Osterhart | H01R 13/4365 439/595 |
| 8,727,816 | B2 * | 5/2014 | Takahashi | H01R 13/4361 439/595 |
| 8,784,141 | B2 * | 7/2014 | Ishikawa | H01R 43/20 439/595 |

* cited by examiner

*Primary Examiner* — Khiem Nguyen

(74) *Attorney, Agent, or Firm* — Finnegan, Henderson, Farabow, Garrett & Dunner LLP

(57) ABSTRACT

An electrical connector is configured to be electrically coupled to a mating connector. The connector includes a housing having a contact chamber and a connector face. The connector further includes a contact connector element accommodated in the contact chamber. The contact connector element includes a primary locking member configured to latch with the contact chamber. The connector also includes a secondary locking member assembled to the housing via the connector face. The secondary locking member is configured to interlock the contact connector element in the housing.

20 Claims, 11 Drawing Sheets

CONNECTOR AND MATING CONNECTOR

CROSS-REFERENCE TO RELATED APPLICATION

This application is based upon and claims the benefit of prior German Application No. 10 2013 019 874.7, filed on Nov. 28, 2013, the entire contents of which are incorporated herein by reference.

TECHNICAL FIELD

The disclosure relates to a connector and a mating connector for the electrical connection of a contact connector element of the connector and a mating contact connector element of the mating connector.

BACKGROUND

In the automotive field, especially when high currents are to be transmitted, connectors are used, which have contact chambers into which suitable contact connector elements can be inserted, which are locked in the housing by means of a primary and a secondary locking members. For example, a primary locking can be achieved via latching arms of the contact connector elements, which latch behind protrusions in the contact chamber. In addition, the connector has a secondary locking member that holds the contact connector element in the housing if the primary locking member disengages.

For example, DE 10 2012 013 657 A1 discloses a connector with a housing in which a contact connector element is interlocked with a primary and a secondary locking members. The secondary locking member is inserted into the housing from a side, e.g., essentially perpendicularly to a connecting direction of the connector, to prevent a movement of the contact connector elements in the connecting direction. Corresponding housings are usually produced using a synthetic material by means of an injection molding process, with a lateral insert in the mould keeping a channel free during the injection molding for the insertion of the secondary locking member. To prevent moisture from entering into the connector, the channel is generally sealed after the injection molding. This requires a rather high effort for the production of a connector of this kind.

SUMMARY

One object of the present disclosure is to provide a connector for the electrical connection of a contact connector element of the connector and a mating connector element of a mating connector, with the connector having a secondary locking member, but nevertheless being easy to produce and easy to seal. Another object of the disclosure is to propose an advantageous mating connector for the connector.

According to the disclosure, there is provided a connector for the electrical connection of a contact connector element of the connector and a mating contact connector element of a mating connector. The connector includes a housing with a contact chamber to accommodate a contact connector element. The housing has a connector face through which the mating contact connector element engages in the contact connector element if the connector and the mating connector are interconnected. The connector face can essentially run perpendicular to a connecting direction of the connector. Additionally, the connector according to the invention comprises a secondary locking member for the secondary locking of the contact connector element in the housing. According to the disclosure, the housing is set up for assembly and actuation of the secondary locking member via the connector face.

With a conventional connector, a secondary locking member is generally inserted perpendicularly to the connecting direction of the connector. To facilitate the direction of insertion, an additional insert is needed in the mold in the injection molding procedure. The additional insert is obsolete if the secondary locking member is inserted into the connector via the connector face of the connector. This makes the connector according to the disclosure easier to produce. Furthermore, it is also easier to seal because it does not have a lateral opening for the secondary locking member. There is also an added advantage that the secondary locking member is easier to actuate by a user and the latching position of the secondary locking member can be recognized easily via the connector face.

In one embodiment, the housing has at least one assembly guide rail to guide the secondary locking member as the secondary locking member is inserted into the housing. For example, the guide rail runs essentially parallel to a connecting direction of the connector and/or essentially perpendicular to the connector face. Generally, the connector face runs essentially perpendicular to the connecting direction of the connector. This is not absolutely necessary, however. As far as the connector face runs essentially perpendicular to the connecting direction of the connector, the assembly guide rail can run essentially parallel to the connecting direction of the connector, as well as essentially perpendicularly to the connector face. The assembly guide rail facilitates a targeted positioning of the secondary locking member in the housing.

The housing can have at least one locking guide rail to guide the secondary locking member when locking the contact connector element in the housing. In some embodiments, the assembly guide rail and the locking guide rail are positioned essentially perpendicular relative to one another. The assembly guide rail and the locking guide rail can therefore be different rails, but they will generally be interconnected.

With a conventional connector, the assembly direction of the secondary locking member and its locking direction run parallel to one another. For example, in DE 10 2012 013 657 A1, the secondary locking member is moved laterally into the connector and at first latches onto a pre-locking position at the lateral latching grooves. By pressing further into the same direction, the secondary locking member is moved into its final latching position. The perpendicular arrangement of the assembly guide rail relative to the locking guide rail abandons the conventional principle according to which the assembly direction and the locking direction run parallel to one another. Compared to conventional connectors, the locking direction of the secondary locking member consistent with embodiments of the disclosure can indeed be maintained. If the assembly direction of the secondary locking member is then essentially perpendicular to the locking direction, there is the advantage that an assembly of the secondary locking member can be facilitated via the connector face and a user who looks at the connector face can easily recognize the position of the secondary locking member.

In one embodiment, the housing has a plurality of contact chambers to accommodate a plurality of contact connector elements, which are preferably secondarily interlocked in the housing by means of a single secondary locking member. For example, the contact chambers and the secondary locking member can be arranged in the housing in such a manner that the secondary locking member can be slid between the contact connector elements located in the housing to lock the contact connector elements in the housing. In this manner, a plurality of contact connector elements can be interlocked in the housing with a single secondary locking member, which saves material and lowers production costs.

The secondary locking member can have a detent latch, and the housing can have a pre-locking groove and a final latching groove. The position at which the detent latch engages with the pre-locking groove can be referred to as a pre-locking position of the secondary locking member. When the detent latch engages in the final latching groove, such position of the secondary locking member is generally referred to as a final latching position. In the pre-locking position, the secondary locking member is already fastened in the housing, but the contact connector element can still be inserted into the housing and removed from the housing. In the final latching position, a contact connector element located in the housing is locked.

To lock the secondary locking member, it can be slid along the locking guide rail. For example, the detent latch can run essentially perpendicular to the locking guide rail opposite the connecting direction of the connector. The pre-locking groove and the final latching groove can be developed as elongated recesses, for example, with their main axes of extension running parallel to the connector face and perpendicular to the locking guide rail. In some embodiments, the pre-locking groove and the final latching groove are arranged in the housing along the locking direction of the secondary locking member. Therefore, proceeding from the assembly guide rail, the detent latch first latches onto the pre-locking groove and then into the final latching groove if the secondary locking member moves along the locking direction.

In some embodiments, the secondary locking member has at least one contour element. The at least one contour element, for example, can move the secondary locking member into its final latching position if the connector and the mating connector are connected and the secondary locking member is not yet in its final latching position. Alternately or in addition, the at least one contour element can have the purpose of securing the secondary locking member in its final latching position if the connector and the mating connector are interconnected.

An exemplary secondary locking member according to the disclosure has a main body from which a manipulation element and at least one locking arm extend. In some embodiments, the manipulation element essentially runs perpendicular to a locking direction of the secondary locking member. In the case when the locking direction essentially runs parallel to the connector face, the secondary locking member can be actuated in a simple manner via the connector face.

In one embodiment, the at least one contour element of the secondary locking member is formed by the manipulation element described immediately above. The fact that the same element is used simultaneously for touching the secondary locking member and moving it into its final latching position, and/or for securing the secondary locking member in its final latching position, leads to savings in terms of both material and cost.

The manipulation element can have an arc or also a ramp to facilitate a sliding along a mating connector ramp of the mating connector. It is possible that the manipulation element protrudes beyond the connector face in a connecting direction of the connector. In this manner, the secondary locking member can be secured in its final latching position by means of an especially simple element of the mating connector, for example by means of a slot into which the manipulation element engages.

In one embodiment of the secondary locking member according to the disclosure, the manipulation element is supported by a reinforcing element that is connected to the manipulation element and the main body. In some embodiments, the reinforcing element has a ramp that forms a corresponding contour element. The ramp can slide especially easily along a mating connector ramp of the mating connector.

Additionally, the secondary locking member can have an additional contour element in the form of an additional ramp, which has an incline opposite an incline of the ramp. If a ramp and an additional ramp are provided with opposite inclines, the secondary locking member can be moved from the pre-locking position or even from a position that inadvertently exceeds the final latching position, into the final latching position and secured there. The ramp and the additional ramp secure the secondary locking member in its final latching position in two directions so that the secondary locking member cannot leave its final latching position, not in the direction of the pre-locking position nor in a direction that exceeds the final latching position.

According to another aspect, the disclosure comprises a mating connector for the electrical connection of a mating contact connector element of the mating connector and a contact connector element of a connector according to the disclosure. The mating connector has at least one interaction element to interact with the secondary locking member of the connector. Because of this, additional functions can be integrated into the connector and/or the mating connector and/or their combination, such as, for example, that the secondary locking member is moved automatically into its final latching position if the connector and the mating connector are interconnected and the secondary locking member is not yet in its final latching position. Furthermore, the interaction element can serve to secure the secondary locking member in its final latching position if the connector and the mating connector are interconnected.

In one embodiment of the mating connector, such an interaction element is formed by a mating connector ramp, for example, which is arranged and designed in such a manner that a contour element of the secondary locking member slides along the mating connector ramp while the connector is being connected to the mating connector if the secondary locking member is not yet in the final latching position so that the secondary locking member is moved into the final latching position. In this manner, the connector and the mating connector can be connected, for example, if the secondary locking member is still in the pre-locking position. In this situation, the contact connector elements in the housing still have a certain amount of play, which means that less connecting force is required to connect the connector and the mating connector. The contact connector elements are nevertheless secondarily locked in the housing because the secondary locking member is moved automatically into its final latching position when the connector and the mating connector are being connected.

In another embodiment of the mating connector, an interaction element is formed by a mating connector ramp, and an additional interaction element is formed by an additional mating connector ramp, which are arranged and developed in such a fashion that a contour element of the at least one contour element of the secondary locking member, in particular the ramp mentioned above or the additional ramp mentioned above, slide along the mating connector ramp or the additional mating connector ramp, depending on a position of the secondary locking member, as the connector is being connected to the mating connector if the secondary locking member is not yet in its final latching position so that the secondary locking member is moved into the final latching position. In doing so, an incline of the mating connector ramp can be especially opposite an incline of the additional mating connector ramp.

Because of the mating connector ramp and the additional mating connector ramp, the secondary locking member can be moved into the final latching position from the pre-locking position or from a position that inadvertently exceeds the final latching position. Furthermore, the mating connector ramp and the additional mating connector ramp secure the secondary locking member in its final latching position in both directions if the connector and the mating connector are interconnected.

The mating connector often has a mating connector face that runs essentially orthogonally to a connecting axis of the mating connector. The aforementioned mating connector ramp and/or the additional mating connector ramp can each run in a plane that is respectively spanned by a first vector that runs in the plane of the mating connector face orthogonally to the locking direction of the secondary locking member, and a respective second vector, which runs orthogonally to the first vector and is positioned relative to the connecting axis of the mating connector at an angle of 10° to 70°. In some embodiments, the angle is between 30° and 45°. In that angle range, the contour element can slide easily along the mating connector ramp and/or the additional mating connector ramp with efficient use of the available construction space. In some embodiments, the second vector that spans the mating connector ramp is different than the second vector that spans the additional mating connector ramp so that the incline of the mating connector ramp is opposite to an incline of the additional mating connector ramp.

In one embodiment of a mating connector, an interaction element is formed by an accommodation device to accommodate a part of the contour element, in particular a part of the manipulation element of the secondary locking member. The accommodation device can be formed and arranged in the mating connector in such a manner that the contour element part engages in the accommodation means when the connector is connected to the mating connector if the secondary locking member is in the final latching position. This secures the secondary locking member in its final latching position.

As already mentioned, the mating connector can have a mating connector face that runs essentially orthogonal to a connecting axis of the mating connector. For example, the accommodation means can be developed as a slot or as a hole in the mating connector face. A slot and/or a hole are simple to produce in order to facilitate a locking of the secondary locking member by the mating connector.

In one embodiment, the plane in which the mating connector ramp runs, and/or the plane in which the additional mating connector ramp runs, intersects a plane of the mating connector face at the accommodation means. In this manner, the contour element can slide along the mating connector ramp or the additional mating connector ramp in such a manner that at the end of the sliding process, a part of the contour element engages in the accommodation means and secures the secondary locking member in its final latching position.

In addition to a connector and a mating connector, the present disclosure, according to an additional aspect, comprises an arrangement of a connector according to the disclosure and a mating connector according to the disclosure. In one embodiment, the arrangement is developed in such a manner that the connector and the mating connector can be interconnected only if the secondary locking member is in the final latching position. Said arrangement is especially easy to realize. For example, it would already be sufficient that the manipulation element of the secondary locking member protrudes beyond the connector face so that it engages in a slot that is arranged in the mating connector face. If the secondary locking member is not in its final latching position in this embodiment, the connector and the mating connector cannot be interconnected because the part of the manipulation element that then protrudes beyond the connector face abuts the mating connector face so that a complete connection of the connector and the mating connector is impossible. The embodiment of a corresponding arrangement realizes one of the ideas of the disclosure in a simple manner because it connects the assembly and actuation of the secondary locking member via the connector face with a simple interaction element of the mating connector.

DESCRIPTION OF THE EMBODIMENTS

In the following, unless noted otherwise, the same elements or elements with the same action are described with the same reference symbols.

Figure 1:
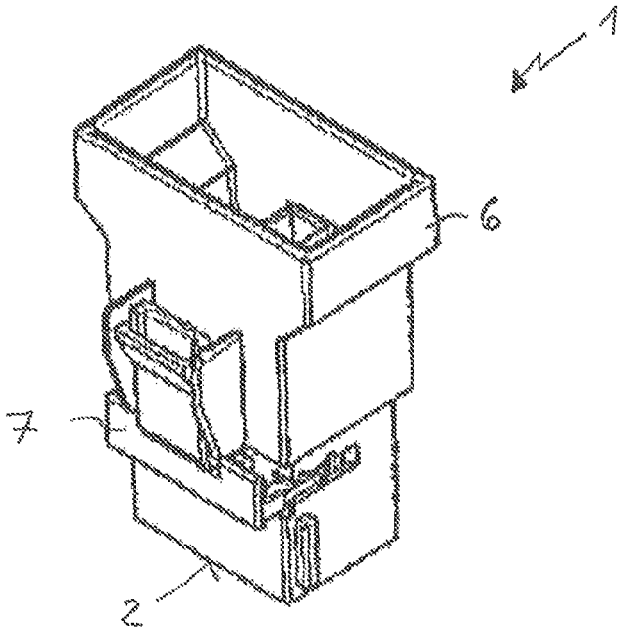
Fig. 1 (Prior Art)
FIG. 1 shows a conventional connector in a view diagonally from above.
Figure 2:
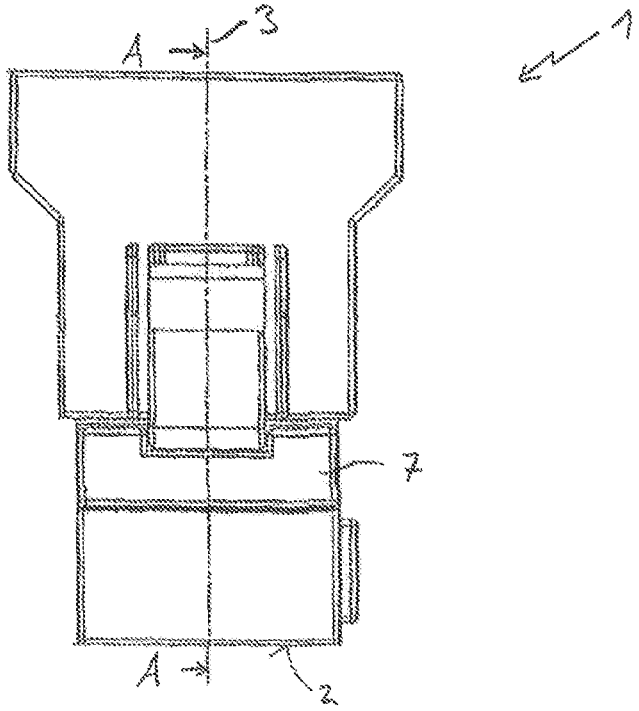
Fig. 2 (Prior Art)
FIG. 2 shows the connector in FIG. 1 in a lateral view.
Figure 3:
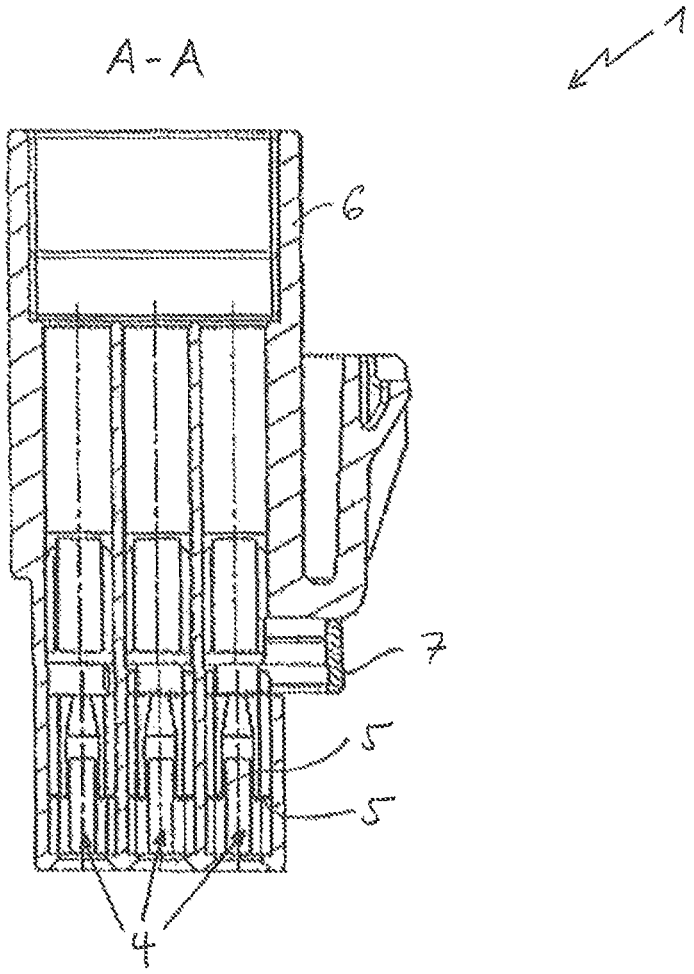
Fig. 3 (Prior Art)
FIG. 3 is a cross-sectional view of the connector in FIG. 2.
Figure 4:
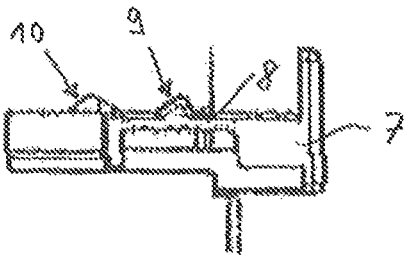
Fig. 4 (Prior Art)
FIG. 4 shows a secondary locking member of the connector in FIG. 1.
Figure 5:
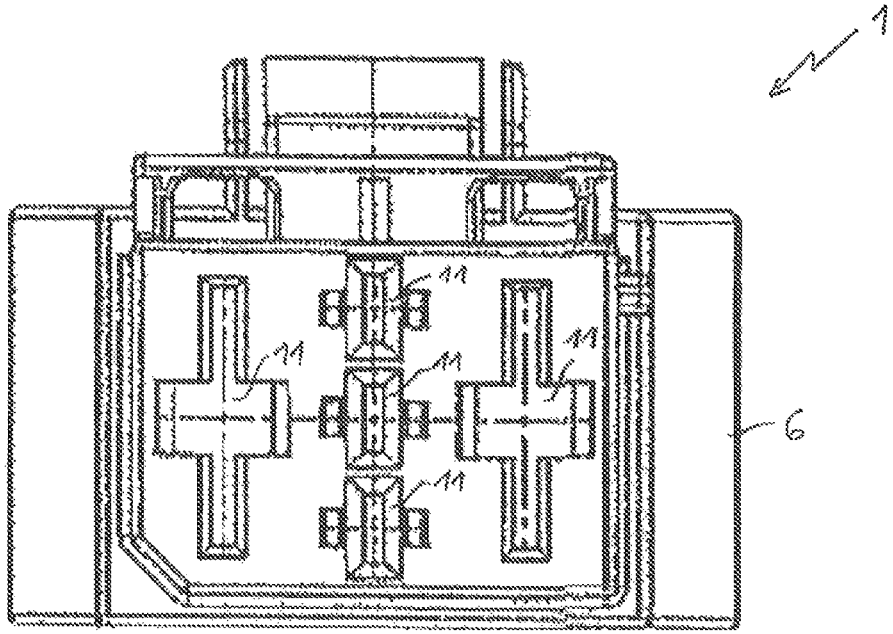
Fig. 5 (Prior Art)
FIG. 5 shows the connector in FIG. 1 in a view from below towards a face of the connector.
Figure 6:
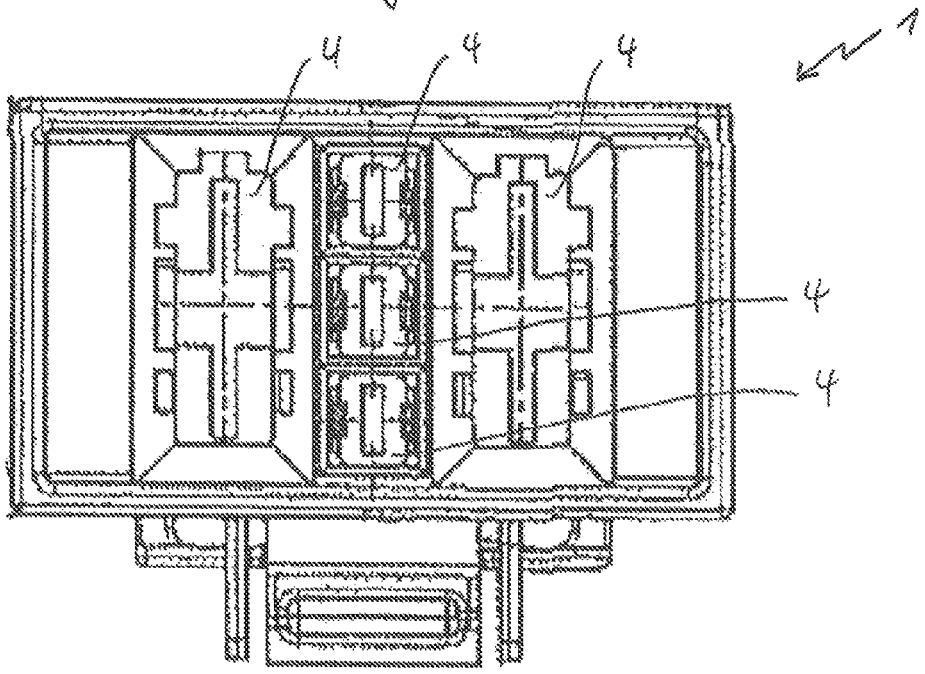
Fig. 6 (Prior Art)
FIG. 6 shows the connector in FIG. 1 in a view from above towards a cable outlet side.

FIGS. 1 to 6 illustrate a conventional connector 1. In FIG. 1, the connector 1 is shown in a perspective view diagonally from above. On the bottom, there is a front face 2 of the connector 1, which is to be connected to a mating connector. FIG. 2 shows the connector 1 in a lateral view. FIG. 3 shows a cross-sectional view of the connector 1 cut along an intersecting line 3 in FIG. 2 and viewed at a direction indicated by reference symbol A. FIG. 3 shows contact chambers 4 into which contact connector elements can be inserted. Each of the contact chambers 4 has protrusions 5, behind which latching arms of the contact connector element latch to achieve a primary locking in a housing 6 of the connector 1. Additionally, the connector 1 has a secondary locking member 7, which further locks the contact connector elements in the housing 6. The secondary locking member 7 is inserted into the housing 6 laterally, e.g., perpendicular to the connecting direction of the connector 1. The secondary locking member 7 is shown again in FIG. 4 in an enlarged view. The secondary locking member 7 has a detent latch 8, which engages here with a pre-locking groove 9 of the housing 6. In addition, the housing 6 has a final latching groove 10. In FIG. 5, the connector 1 is shown again from below, e.g. with view toward the front face 2. Openings 11 in the housing 6, through which the mating contact connector elements are inserted to engage with the contact connector elements located in the contact chambers 4 of the housing 6, are clearly visible. FIG. 6 shows the connector 1 again from the top, e.g. with a view of the cable outlet side of the connector 1, thus rendering the contact chambers 4 clearly visible.

Figure 7:
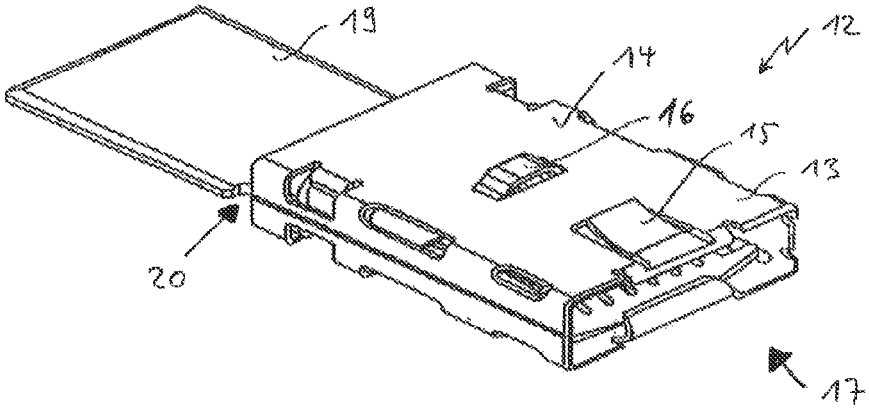
FIG. 7 shows a commercial contact connector element in a perspective view.
Figure 8:
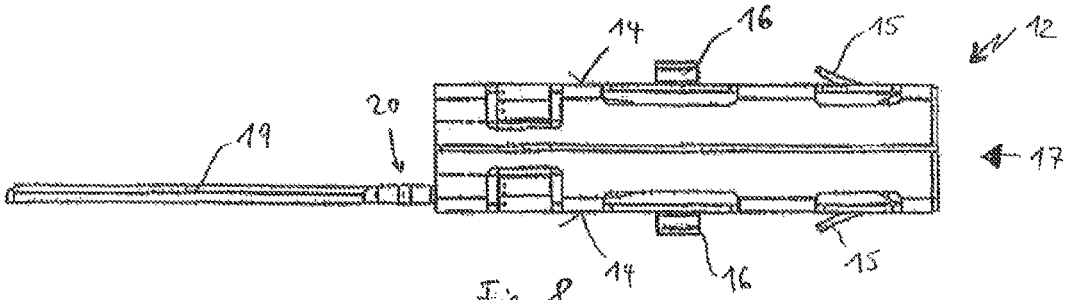
FIG. 8 shows the contact connector element in FIG. 7 in a lateral view.
Figure 9:
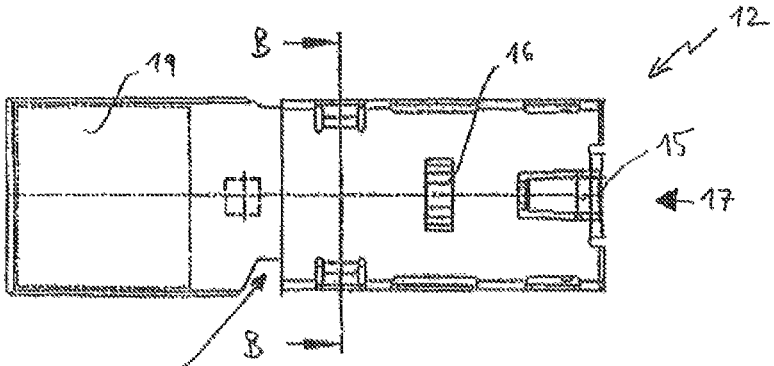
FIG. 9 shows the contact connector element in FIG. 7 in a view towards a side wall of the contact connector element.
Figure 10:
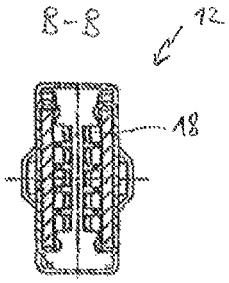
FIG. 10 is a cross-sectional view of the contact connector element in FIG. 7.

FIGS. 7 to 10 illustrate a commercial contact connector element 12. The contact connector element 12 is shown in FIG. 7 in a perspective view, in FIG. 8 in a view toward a small wall, and in FIG. 9 in a view toward a large side wall of the contact connector element 12. FIG. 10 shows the contact connector element 12 in a cross-sectional view along a line B-B drawn in FIG. 9. The contact connector element 12 includes a metal sheet 13, which is bent so that it essentially forms a building block. This creates large side walls 14, each of which have a latching arm 15 and a tab 16. The latching arms 15 can latch behind the protrusions 5 of the connector 1. At a front face 17, the mating contact connector element can be inserted, which is held by means of lamellae 18 represented in FIG. 10. At a side of the metal sheet 13 opposite the front face, a contact plate 19 is attached, to which a cable can be fastened, for example. As shown in FIG. 9, the contact plate 19 has a recess 20 in which the secondary locking member 7 can engage to secondarily interlock the contact connector element 12 in the housing 6. The secondary locking member therefore provides a positive locking.

Figure 11:
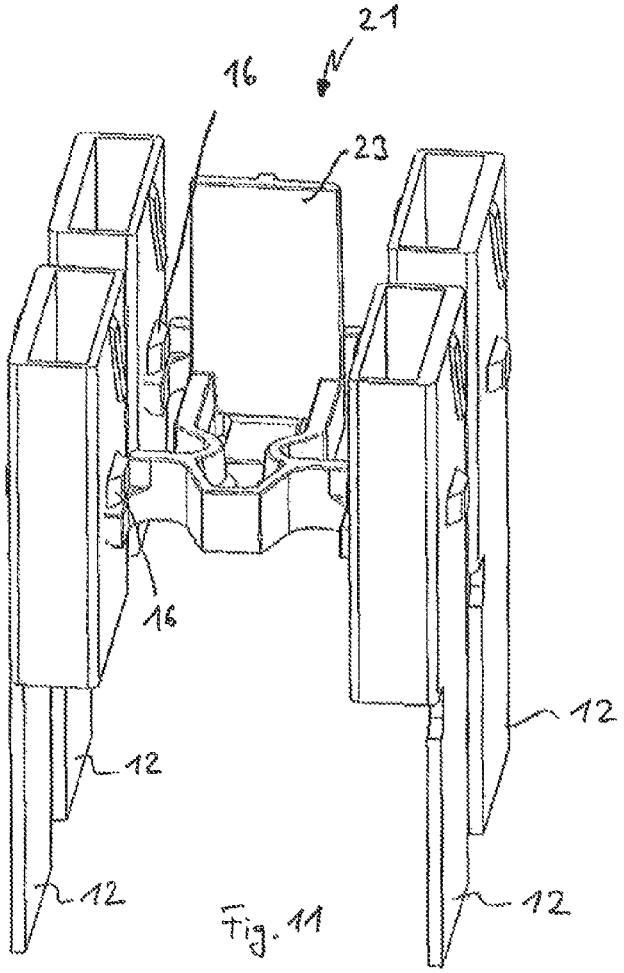
FIG. 11 shows a secondary locking member as it can be used in a connector according to an exemplary embodiment, with contact connector elements.
Figure 12:
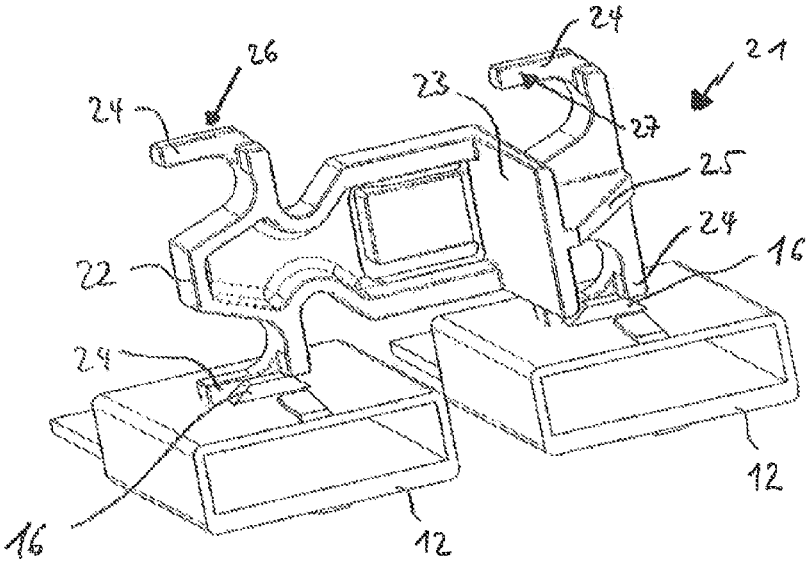
FIG. 12 shows the secondary locking member in FIG. 11 in a view diagonally from above.
Figure 13:
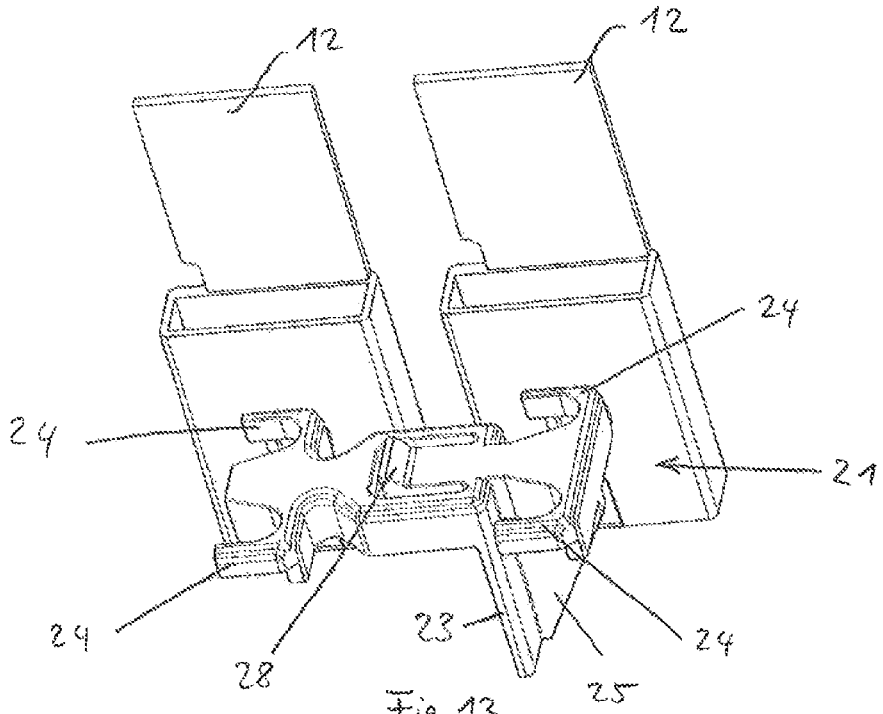
FIG. 13 shows the secondary locking member in FIG. 11 in a view diagonally from below.

FIGS. 11 to 13 illustrate an exemplary secondary locking member 21 as it can be used in a connector according to the disclosure. In FIG. 11, the secondary locking member 21 is shown from the front, in FIG. 12 diagonally from above, and in FIG. 13 from diagonally from below. The secondary locking member 21 has a main body 22 from which a manipulation element 23 and four locking arms 24 extend. The manipulation element 23 is supported by a reinforcing element 25 that is connected to the manipulation element 23 and the main body 22. As shown in FIG. 11, the secondary locking member 21 has a ramp 26 on each locking arm 24. Each ramp 26 presses against a side wall 14 of the contact connector elements 12 and thus presses an another side wall 14 of the contact connector element 12 against the housing (not shown). As FIG. 11 illustrates, the secondary locking member 21 is therefore slid between the contact connector elements 12 so that the contact connector elements 12 are pressed against the housing and a frictional connection is created between the contact connector elements 12 and the housing. The locking arms 24 each furthermore have a respective additional incline 27, which respectively slides under the tab 16 of the contact connector elements 12. In the orientation of the secondary locking member shown in FIG. 12, the additional incline 27 is above the locking arms 24. FIG. 13 shows that the secondary locking member 21 has a detent latch 28, the function of which will be explained in the following with reference to FIG. 14.

Figure 14:
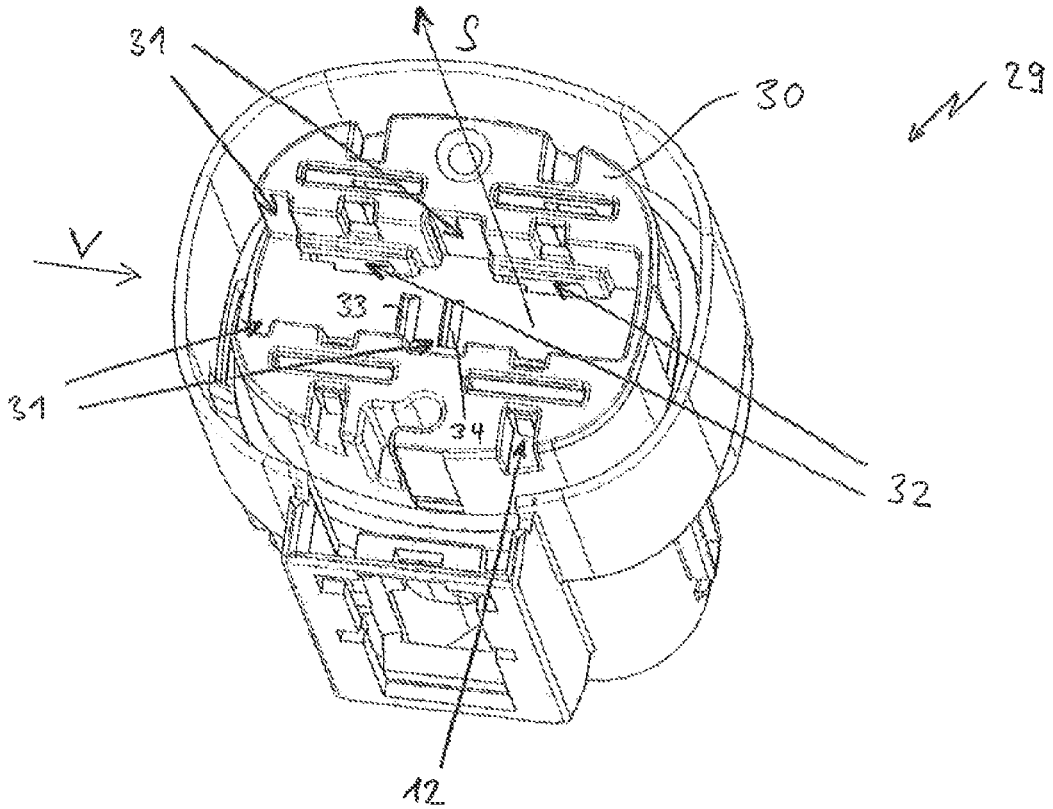
FIG. 14 shows a housing of a connector according to an exemplary embodiment.

FIG. 14 shows an exemplary housing 29 according to the disclosure. The housing 29 has a connector face 30 through which the mating contact connector elements 12 engage with the contact connector elements 12 if the connector and the mating connector are interconnected. The connector face 30 is perpendicular to a connecting direction S of the connector. By using a plurality of assembly guide rails 31 to guide the secondary locking member 21 when the secondary locking member 21 is inserted into the housing 29, the housing 29 is set up for an assembly of the secondary locking member 21 via the connector face 30. The assembly guide rails 31 run parallel to the connecting direction S of the connector and therefore perpendicular to the connector face 30. In addition, the housing 29 has a plurality of locking guide rails 32 to guide the secondary locking member 21 when the contact connector elements 12 are locked in the housing 29, with the assembly guide rails 31 and the locking guide rails 32 being positioned perpendicularly relative to one another. Because of the locking guide rails 32, the housing 29 is set up for an actuation of the secondary locking member 21 via the connector face 30 because the secondary locking member 21 can be slid along the locking guide rails 32 for locking.

For the definition of the pre-locking position and a final latching position of the secondary locking member 21, the housing 29 has a pre-locking groove 33 and a final latching groove 34, which are developed as elongated recesses and have main axes of orientation that run parallel to the connector face 30 and perpendicular to the locking guide rails 32. The pre-locking groove 33 and the final latching groove 34 are arranged in the housing 29 in such a fashion along a locking direction V of the secondary locking member 21 that proceeding from the assembly guide rails 31, the detent latch 28 first latches onto the pre-locking groove 33 and then into the final latching groove 34 when the secondary locking member 21 moves along the locking direction V. If the detent latch 28 of the secondary locking member 21 engages with the pre-locking groove 33, the secondary locking member 21 is in its pre-locking position. In the final latching position of the secondary locking member 21, the detent latch 28 latches onto the final latching groove 34.

By arranging the secondary locking member 21 within the housing 29, the housing 29 can be easily sealed against moisture, for example by means of a simple conical nipple between the connector and the mating connector, because compared to conventional connector housings, the secondary locking member 21 does not need a lateral opening. In addition, the secondary locking member 21 can be actuated conveniently with the help of the manipulation element 23 via the connector face 30 and its latching position is visible from the connector face 30.

Figure 15:
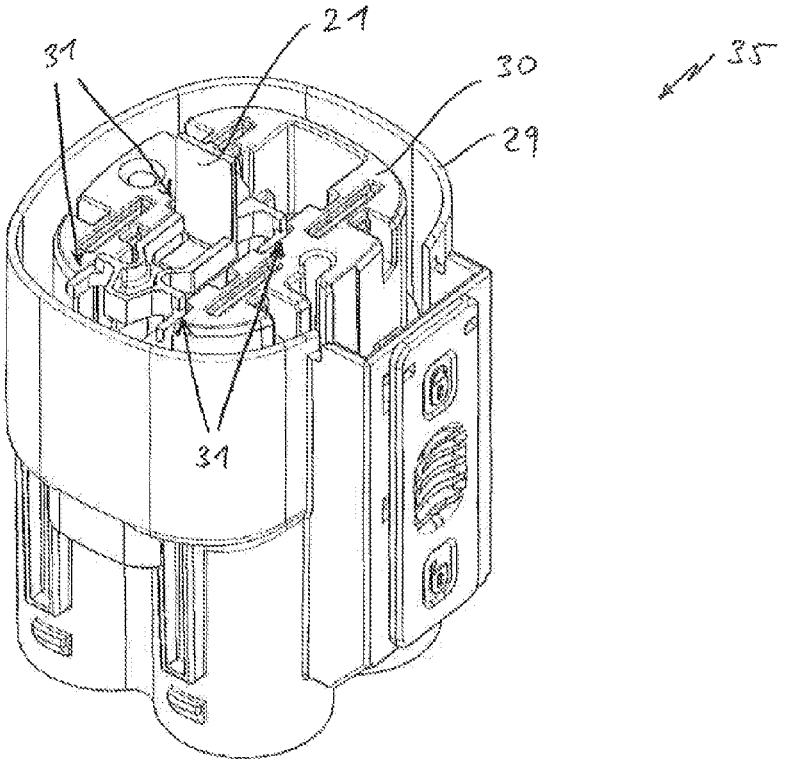
FIG. 15 shows the housing in FIG. 14, as a secondary locking member is being inserted.
Figure 16:
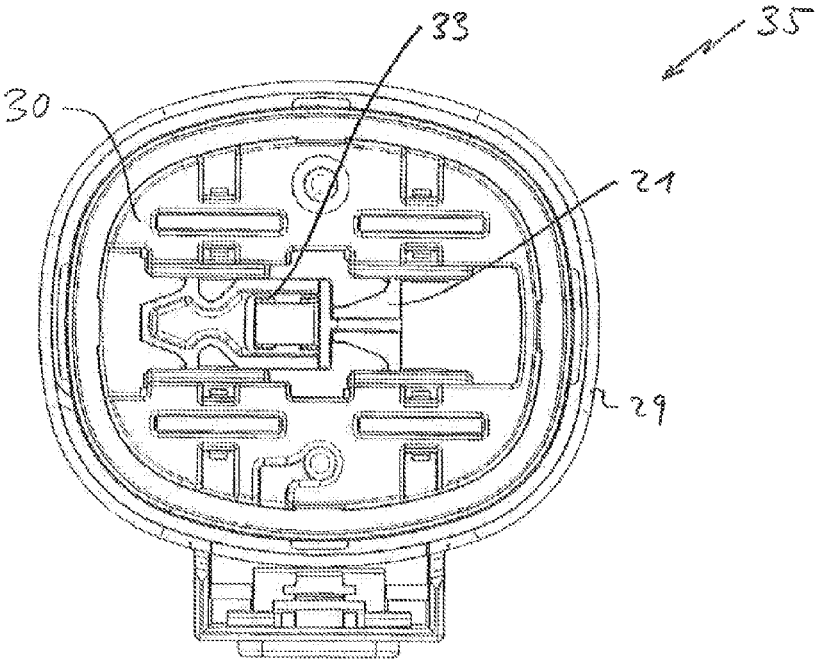
FIG. 16 shows a connector according to an exemplary embodiment, with a secondary locking member in the pre-locking position.
Figure 17:
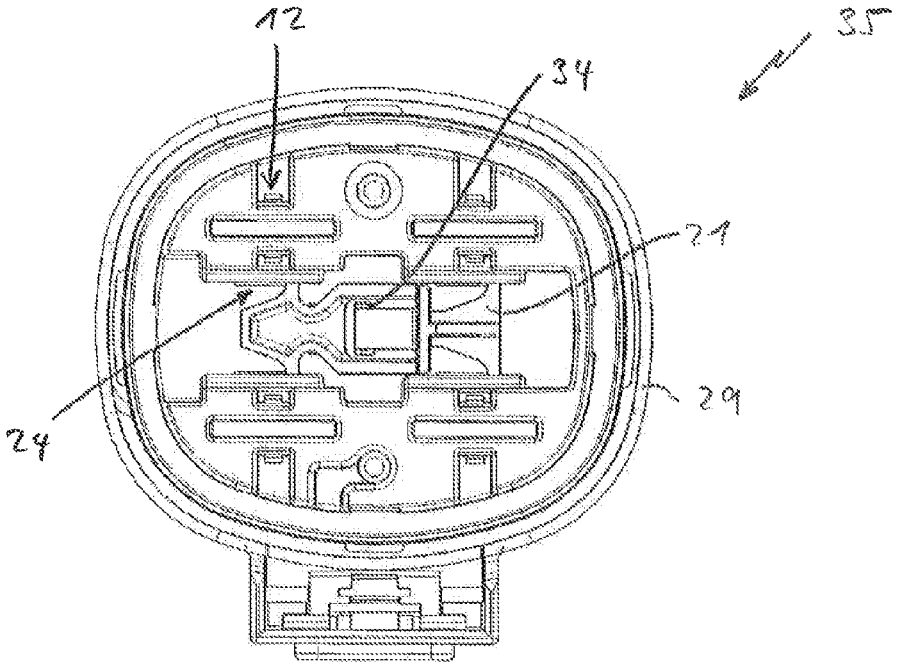
FIG. 17 shows the connector in FIG. 14 with the secondary locking member in a final latching position.

FIG. 15 illustrates how the secondary locking member 21 can be inserted into the housing 29 via the assembly guide rails 31 to create an exemplary connector 35 according to the disclosure. As soon as the secondary locking member 21 has been inserted into the housing 29, it can be slid along the locking guide rails 32 shown in FIG. 14 into its pre-locking position, as shown in FIG. 16. In FIG. 17, the connector 35 is shown again in the final latching position of the secondary locking member 21. It is shown there that the locking arms 24 are then at the level of the contact connector elements 12, which are secondarily interlocked.

Figure 18:
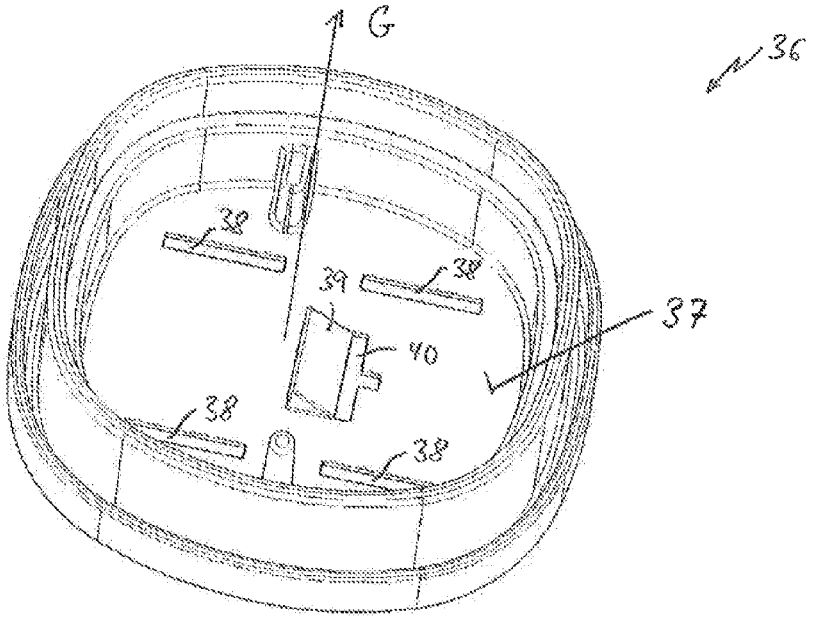
FIG. 18 shows a mating connector according to an exemplary embodiment.

FIG. 18 shows an exemplary mating connector 36 according to the disclosure. The part of the mating connector 36 at the cable outlet side is not shown so as not to obstruct the view to accommodation means 40 in FIG. 21. The mating connector 36 has a mating connector face 37 which runs orthogonally to a connecting axis G of the mating connector 36. Four openings 38 are arranged in the mating connector face 37 for mating contact connector elements that are to engage with the contact connector elements 12 of the connector 35. In addition, the mating connector 36 has two interaction elements to interact with the secondary locking member 21 of the connector 35, e.g., a mating connector ramp 39 and the accommodation means 40 to accommodate part of the manipulation element 23 of the secondary locking member 21.

The mating connector ramp 39 is arranged on the mating connector face 37 in such a fashion that the manipulation element 23 of the secondary locking member 21 slides along the mating connector ramp 39 as the connector 35 is being connected to the mating connector 36, if the secondary locking member 21 is not yet in final latching position. The mating connector ramp 39 runs in a plane that is spanned by a first vector that runs in the plane of the mating connector face 37 orthogonally to the locking direction V of the secondary locking member 21, and a second vector, which is orthogonally relative to the first vector and in an angle of 30 degrees to 45 degrees to the connecting axis G of the mating connector 36. The plane in which the mating connector ramp 39 runs intersects a plane of the mating connector face 37 at the accommodation means 40. In this way, the manipulation element 23 of the secondary locking member 21 slides along the mating connector ramp 39 in such a manner that it engages in the accommodation means 40 at the end of the mating connector ramp 39 so that the secondary locking member 21 is additionally secured in its final latching position. The accommodation means 40 is developed as a slot, with an essentially perpendicular lateral side slot in the mating connector face 37. To engage in the slot, the manipulation element 23 protrudes beyond the connector face 30 in the connecting direction S of the connector 29.

Figure 19:
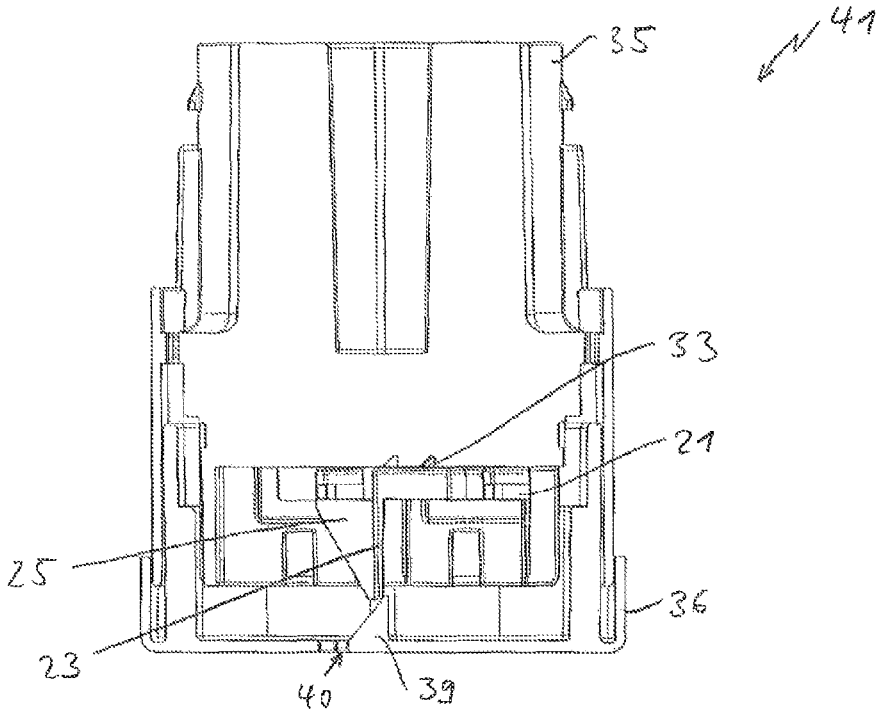
FIG. 19 is a cross-sectional view of an arrangement according to an exemplary embodiment, with a connector and the mating connector in FIG. 18 as the connector is being interconnected with the mating connector.
Figure 20:
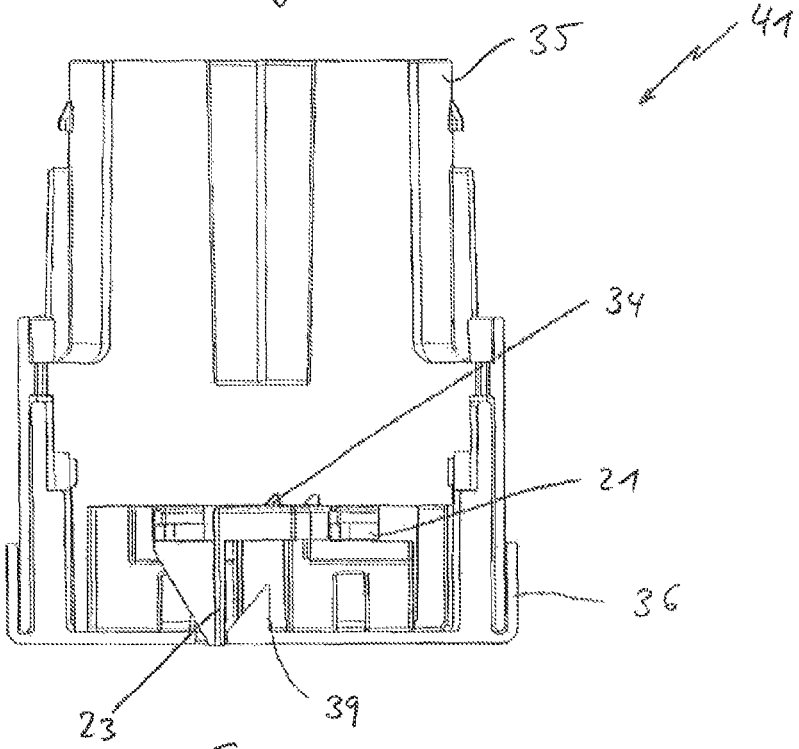
FIG. 20 shows the arrangement in FIG. 19 in a cross-sectional view, with the connector being connected to the mating connector.

FIGS. 19 and 20 show a cross-sectional view of an exemplary arrangement 41 according to the disclosure, including the connector 35 and the mating connector 36. The function of the mating connector ramp 39. In FIG. 19, the secondary locking member 21 is in the pre-locking position so that the detent latch 28 engages with the pre-locking groove 33. The manipulation element 23 of the secondary locking member 21, which is supported by the reinforcing element 25, touches the mating connector ramp 39 at its beginning and slides along the mating connector ramp 39 as the connector 35 is being connected to the mating connector 36 so that the secondary locking member 21 is moved in the direction of its final latching position.

FIG. 20 shows that the manipulation element 23 of the secondary locking member 21, once it has fully slid along the mating connector ramp 39, engages with the accommodation means 40 while the detent latch 28 of the secondary locking member 21 latches onto the final latching groove 34. In this manner, the secondary locking member 21 is secured twice in its final latching position.

Figure 21:
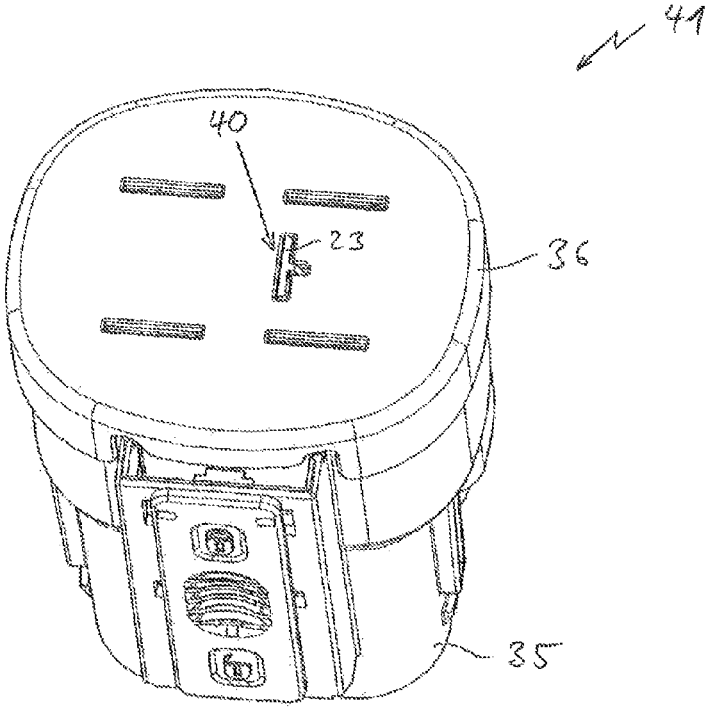
FIG. 21 shows the arrangement in FIG. 20 in a perspective view diagonally from above against a connecting direction of the connector.

FIG. 21 shows the arrangement 41 of the connector 35 and the mating connector 36 in a perspective view opposite the connecting direction S of the connector diagonally from above. The connector 35 is completely inserted into the mating connector 36 so that a part of the manipulation element 23 and the reinforcing element 25 of the secondary locking member 21 is visible through the accommodation means 40.

Figure 22:
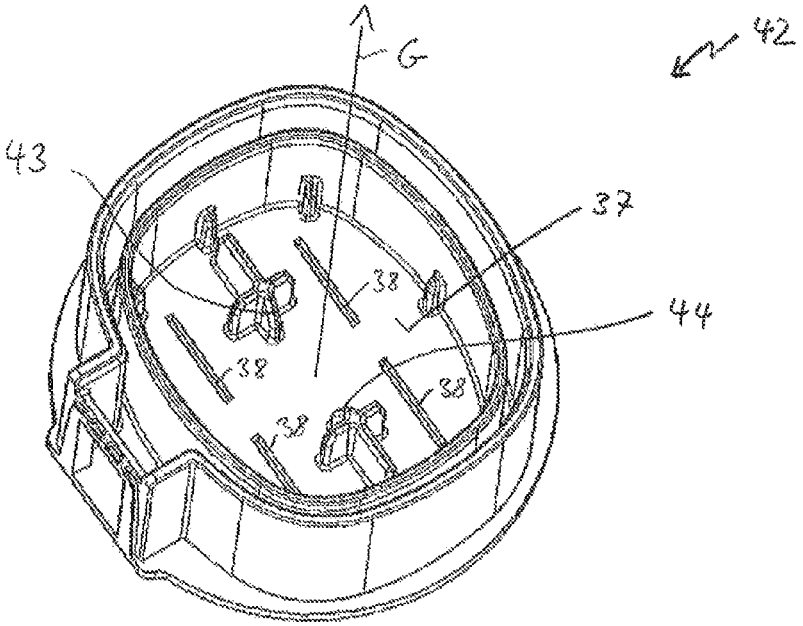
FIG. 22 shows a mating connector according to another exemplary embodiment.

FIG. 22 shows another exemplary mating connector 42 according to the disclosure. In FIG. 22, the cable outlet side is not shown for simplification. Again, four openings 38 for mating contact connector elements are arranged in the mating connector face 37, which are to engage with the contact connector elements 12 of the connector 35. On the mating connector face 37, two interaction elements are arranged, which interact with the secondary locking member 21 of the connector 35 if the connector 35 is connected to the mating connector 42. The two interaction elements are a mating connector ramp 43 and an additional mating connector ramp 44. The mating connector ramp 43 and the additional mating connector ramp 44 are arranged on the mating connector face 37 in such a fashion that a contour element of the secondary locking member 21 slides along the mating connector ramp 43 or the additional mating connector ramp 44 while the connector 35 is being connected to the mating connector 42, depending on a position of the secondary locking member 21, if the secondary locking member 21 is not yet in the final latching position. The mating connector ramp 43 runs in a plane that is spanned by two vectors. The first vector runs in the plane of the mating connector face 37 orthogonal to the locking direction V of the secondary locking member 21. The second vector is orthogonal relative to the first vector and in an angle of 30° to 45° relative to the connecting axis G of the mating connector.

Figure 23:
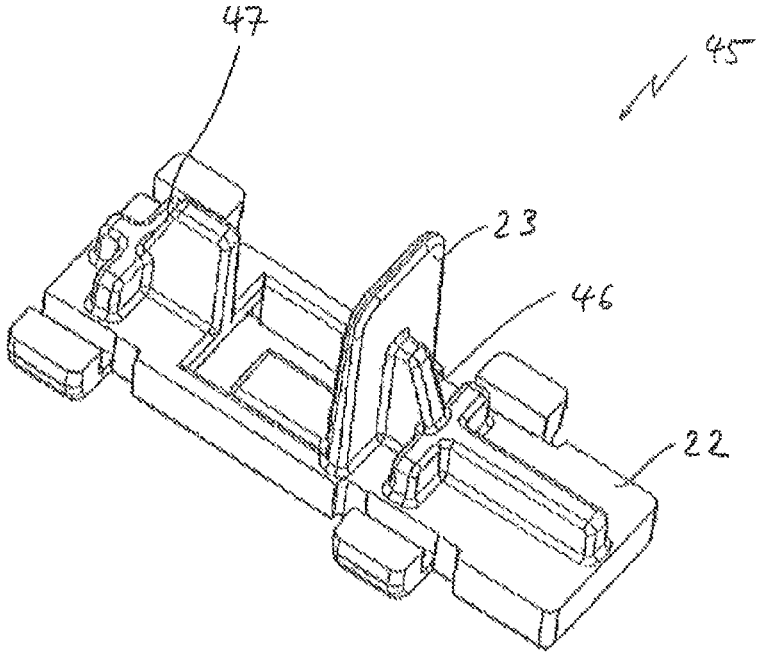
FIG. 23 shows a secondary locking member as it can be used in a connector according to another exemplary embodiment.

FIG. 23 shows another exemplary secondary locking member 45, as it can be used in a connector according to the disclosure. With the shown secondary locking member 45, the reinforcing element that supports the main body is formed differently than with the secondary locking member 21 shown in FIG. 11, so as to provide a ramp 46. Furthermore, the secondary locking member 45 has an additional contour element in form of an additional ramp 47. The incline of the ramp 46 is opposite to the incline of the additional ramp 47. The inclines of the ramp 46 and the additional ramp 47 of the secondary locking member 45 are adapted to the inclines of the mating connector ramp 43 and the additional mating connector ramp 44 of the mating connector 42 shown in FIG. 22.

Figure 24:
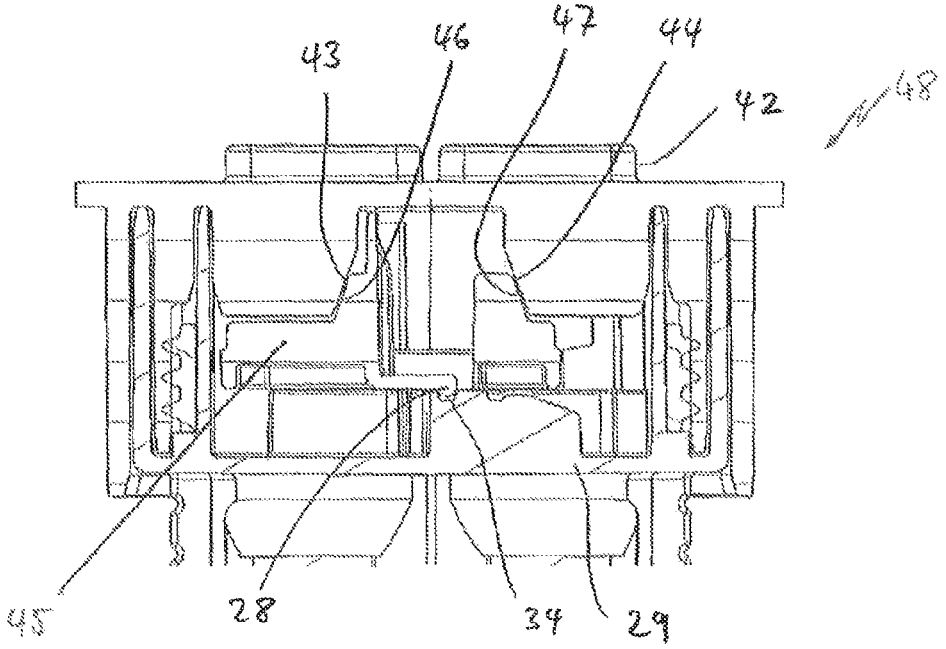
FIG. 24 is a cross-sectional view of an arrangement according to another exemplary embodiment, including a connector and the mating connector in FIG. 22, with the connector being connected to the mating connector.

FIG. 24 shows a cross-sectional view of another exemplary arrangement 48 according to the disclosure including an exemplary connector according to the disclosure and the mating connector 42 in FIG. 22. For example, the arrangement 48 comprises the housing 29 shown in FIG. 14 and the secondary locking member 45 contained therein with the ramp 46 and the additional ramp 47. The mating connector 42 is interconnected with the connector, comprised of the housing 29 and the secondary locking member 45. In this manner, the ramp 46 abuts the mating connector ramp 43, and the additional ramp 47 abuts the additional mating connector ramp 44 so that the secondary locking member 45 is secured in its final latching position.

The explanations offered with reference to the figures are purely illustrative and should not be understood as limiting. Many changes can be made to the shown embodiments without leaving the scope of protection of the invention, as it is established in the attached claims.

LIST OF REFERENCE SYMBOLS

1 Connector
2 Front face
3 Section
4 Contact chamber
5 Protrusion
6 Housing
7 Secondary locking member
8 Detent latch
9 Pre-locking groove
10 Final latching groove
11 Opening
12 Contact connector element
13 Metal sheet
14 Side wall
15 Latching arm
16 Tab
17 Front face
18 Lamellae
19 Contact plate
20 Recess
21 Secondary locking member according to an exemplary embodiment
22 Main body
23 Manipulation element
24 Locking arm
25 Reinforcing element
26 Incline
27 Additional incline
28 Detent latch
29 Housing
30 Pre-locking groove
31 Assembly guide rails
32 Locking guide rail
33 Pre-locking groove
34 Final latching groove
35 Connector according to an exemplary embodiment
36 Mating connector according to an exemplary embodiment
37 Mating connector face
38 Openings for mating contact connector elements
39 Mating connector ramp
40 Accommodation means
41 Arrangement according to an exemplary embodiment
42 Mating connector according to another exemplary embodiment
43 Mating connector ramp
44 Additional mating connector ramp
45 Secondary locking member according to another exemplary embodiment
46 Ramp
47 Additional ramp
48 Arrangement according to another exemplary embodiment
G Connecting axis of the mating connector
S Connecting axis of the connector
V Locking direction of the secondary locking member

What is claimed is:

1. An electrical connector configured to be electrically coupled to a mating connector, the connector comprising:

a housing including:
a contact chamber; and
a connector face;

a contact connector element accommodated in the contact chamber, the contact connector element including a primary locking member configured to latch with the contact chamber; and a secondary locking member assembled to the housing via the connector face, the secondary locking member being configured to interlock the contact connector element in the housing.

2. The connector according to claim 1, wherein the housing includes an assembly guide rail configured to guide the secondary locking member when the secondary locking member is inserted into the housing, the assembly guide rail being substantially parallel to a connecting direction of the connector or substantially perpendicularly to the connector face.

3. The connector according to claim 2, wherein:

the housing further includes a locking guide rail configured to guide the secondary locking member when the contact connector element is being locked in the housing, and the assembly guide rail and the locking guide rail are substantially perpendicular to each other.

4. The connector according to claim 1, wherein:

the housing includes a plurality of contact chambers accommodating a plurality of contact connector elements that are interlocked in the housing by the secondary locking member, and the secondary locking member is configured to slide between the contact connector elements to lock the contact connector elements in the housing.

5. The connector according to claim 1, wherein:

the housing includes a pre-locking groove and a final-locking groove, and the secondary locking member includes a detent latch configured to engage with the pre-locking groove when the secondary locking member is in a pre-locking position and with the final-locking groove when the secondary locking member is in a final-locking position.

6. The connector according to claim 5, wherein the secondary locking member includes at least one contour element configured to more the secondary locking member into the final-locking position and secure the secondary locking member in the final-locking position.

7. The connector according to claim 6, wherein:

the secondary locking member further includes a main body, and the at least one contour element includes a manipulation element extending from the main body in a direction perpendicular to a locking direction of the secondary locking member.

8. The connector according to claim 7, wherein the secondary locking member further includes at least one locking arm extending from the main body.

9. The connector according to claim 6, wherein:

the secondary locking member further includes:
a main body;
a manipulation element extending from the main body; and
a reinforcing element connected to the manipulation element and the main body, the reinforcing element supporting the manipulation element and having a ramp, and the at least one contour element includes the ramp.

10. The connector according to claim 9, wherein:

the ramp is a first ramp having a first incline, the secondary locking member further includes a second ramp having a second incline that is opposite to the first incline.

11. A device comprising:

a connector including:

a housing including:

a contact chamber; and a connector face;

a contact connector element accommodated in the contact chamber, the contact connector element including a primary locking member configured to latch with the contact chamber; and a secondary locking member assembled to the housing via the connector face, the secondary locking member being configured to interlock the contact connector element in the housing; and a mating connector configured to be electrically connected to the contact connector element, the mating connector including at least one interaction element configured to interact with the secondary locking member.

12. The device according to claim 11, wherein:

the secondary locking member includes a contour element, and the at least one interaction element includes a mating connector ramp configured to allow the contour element to slide along the mating connector ramp when the connector and the mating connector are being interconnected.

13. The device according to claim 12, wherein:

the mating connector has a mating connector face that is substantially orthogonal to a connecting axis of the mating connector, and the mating connector ramp extends in a plane spanned by:

a first vector defined on the mating connector face and orthogonal to a locking direction of the secondary locking member, and a second vector orthogonal to the first vector, and forming an angle of 10 to 70 degrees with the connecting axis.

14. The device according to claim 13, wherein the second vector forms an angle of 30 to 45 degrees with the connecting axis.

15. The device according to claim 11, wherein:

the secondary locking member includes a first connector amp and a second connector ramp, the mating connector includes a first interaction element including a first mating connector ramp and a second interaction element including a second mating connector ramp, and the first and second mating connector ramps are configured to allow at least one of the first or second connector ramp to slide along at least one of the first or second mating connector ramp when the connector is being interconnected with the mating connector.

16. The device according to claim 15, wherein:

the mating connector has a mating connector face that is substantially orthogonal to a connecting axis of the mating connector, the first mating connector ramp extends in a first plane spanned by:

a first vector defined on the mating connector face and orthogonal to a locking direction of the secondary locking member, and a second vector orthogonal to the first vector, and forming a first angle of 10 to 70 degrees with the connecting axis, and the second mating connector ramp extends in a second plane spanned by:

a third vector defined on the mating connector face and orthogonal to the locking direction, and a fourth vector orthogonal to the third vector, and forming a second angle of 10 to 70 degrees with the connecting axis, the fourth vector being inclined with respect to the second vector.

17. The device according to claim 11, wherein:

the secondary locking member includes a contour element, and the at least one interaction element includes an accommodation means configured to accommodate at least a part of the contour element, the accommodation means being configured to allow the part of the contour element to engage with the accommodation means when the connector is being interconnected with the mating connector and the secondary locking member is in a final-locking position.

18. The device according to claim 17, wherein:

the mating connector has a mating connector face that is substantially orthogonal to a connecting axis of the mating connector, and the accommodation means includes at least one of a slot or a hole in the mating connector face.

19. The device according to claim 18, wherein the at least one interaction element includes a mating connector ramp, and a plane in which the mating connector ramp extends intersects the mating connector face at the accommodation means.

20. The device according to claim 18, wherein:

the at least one interaction element includes a first mating connector ramp and a second mating connector ramp, and at least one of a first plane in which the first mating connector ramp extends or a second plane in which the second mating connector extends intersects the mating connector face at the accommodation means.

* * * * *